United States Patent [19]

Wilde et al.

[11] Patent Number: 4,665,627

[45] Date of Patent: May 19, 1987

[54] DRY FILM CURING MACHINE WITH ULTRAVIOLET LAMP CONTROLS

[75] Inventors: Herbert J. Wilde, Golden Valley; James F. Mengelkoch, Minnetonka, both of Minn.

[73] Assignee: Research, Incorporated, Eden Prairie, Minn.

[21] Appl. No.: 794,107

[22] Filed: Nov. 1, 1985

[51] Int. Cl.[4] ..... F26B 23/04

[52] U.S. Cl. ..... 34/4; 34/41; 250/372; 250/505.1; 315/149; 315/157

[58] Field of Search ..... 34/4, 41; 250/372, 505.1; 340/501, 600; 315/149, 157

[56] References Cited

U.S. PATENT DOCUMENTS

| | | | |
|---|---|---|---|
| 3,973,328 | 8/1976 | Theobald | 34/4 |
| 3,984,726 | 10/1976 | Ramler | 34/4 |
| 4,015,340 | 4/1977 | Treleven | 34/4 |
| 4,032,817 | 6/1977 | Richmond | 315/149 |

*Primary Examiner*—Larry I. Schwartz

*Attorney, Agent, or Firm*—Kinney & Lange

[57] ABSTRACT

A dry film curing machine utilizes ultraviolet lamps mounted in reflectors, which are positioned on opposite sides of a mesh or open type conveyor belt carrying the film to provide radiation for drying. The lamps are controlled by a circuit that regulates the intensity of the ultraviolet lamps to a set level as the lamp ages. The control is effective even though the arc in the lamp may deflect as the lamp warps under temperature differentials. A sensor is mounted in a housing and is positioned adjacent the lamp. The sensor housing eliminates reflected ultraviolet light from striking the sensor, to eliminate erroneous input signals. The sensor provides a signal that is directly proportional to ultraviolet lamp intensity and this signal is used to adjust the power (primarily the current) to the lamp through a microprocessor controlled power source to maintain the UV intensity at the set level. The intensity level can be adjusted, to provide a wide range of intensities to suit the needs for drying the film that is being carried through the machine. Accurate and controllable curing action is thus obtained. In addition, a separate control insures that a provided fan does not overcool the lamps during periods when the intensity of the UV light is set at a low level.

18 Claims, 7 Drawing Figures

Fig. 1
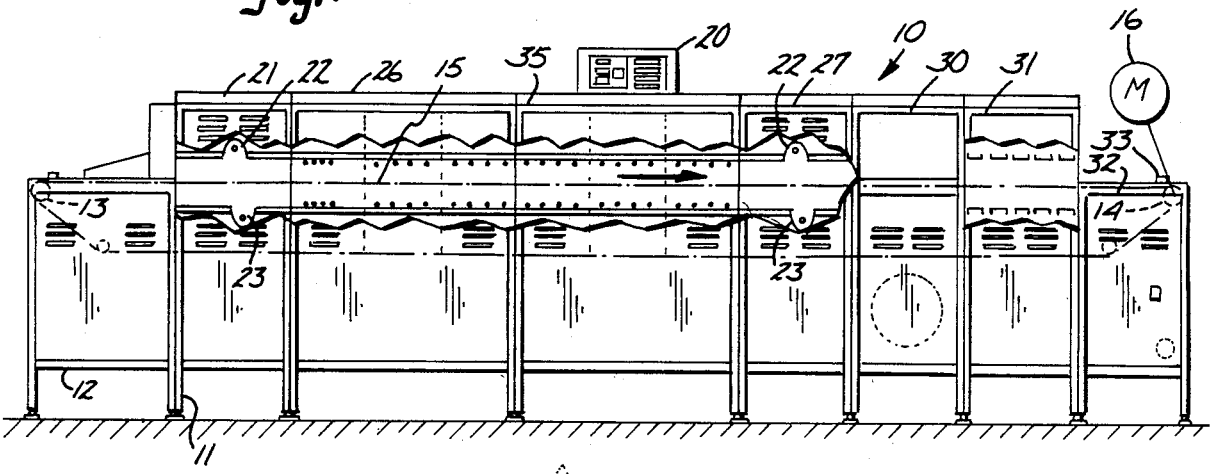
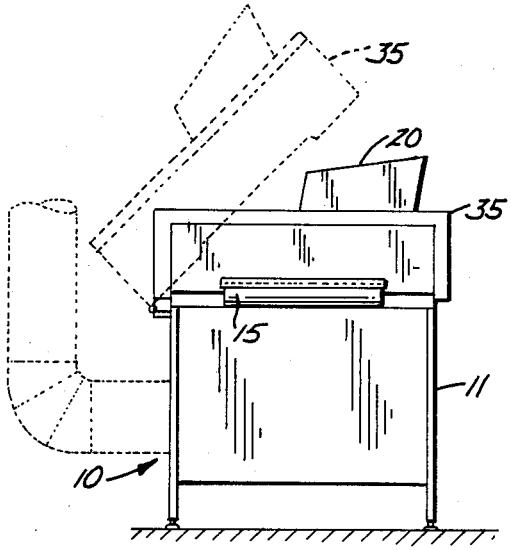
Fig. 2
Fig. 3
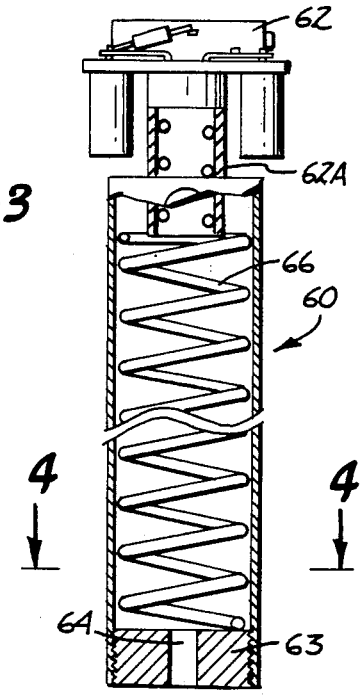
Fig. 4
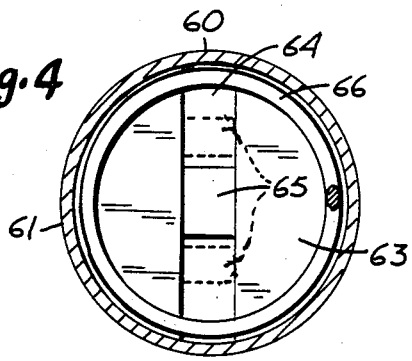

DRY FILM CURING MACHINE WITH ULTRAVIOLET LAMP CONTROLS

BACKGROUND OF THE INVENTION

1. Field of the Invention

The present invention relates to control of ultraviolet lamps, primarily in a dry film curing machine, and provides for precise control of such lamps to insure that they provide a constant desired light intensity at various set levels.

2. Description of the Prior Art

Dry film curing machines are well known, and utilize open mesh belts that carry a film past heaters. Generally these heaters have been infrared heaters for heating the film to a desired level and insuring that the moisture content is reduced sufficiently for use. The dry film curing machine shown schematically herein is well known, and, also, ultraviolet lamps have been known for providing heat to various film drying processes. However, controlling the intensity of ultraviolet lamps is very important, and obtaining automatic controls that are accurate and reliable has been difficult. One primary problem is that conventional sensors are inaccurate. The ultraviolet lamps are elongated, and an arc is formed inside a quartz envelope. The lamp will bow between its supported ends as the temperature of the lamps changes, and the arc also bends and shifts from its start position. Providing a light sensor that will accurately indicate the intensity of the arc even as the arc shifts, has not been achieved.

It has been known that the intensity of ultraviolet lights can be controlled by controlling the power to the lamp and manual power controls have been utilized which adjust the power level up to compensate for lamp aging. The voltage to the lamp has to be maintained above a fairly high level, so the control is primarily a current control.

Another problem occurs, however, when the lamps are being cooled, and the current of the lamps is reduced, the cooling effect may cause the voltage across the lamp to drop significantly. If the voltage drops too far, the lamp power controller will go into its "start" mode automatically, causing a high current surge. Thus there has to be a desirable control of the cooling fan to make sure that the operating voltage is maintained within a reasonable range. If the lamp gets too hot, of course, it is subject to damage, so a fan is necessary.

The present invention provides for controls to make the use of ultraviolets lights possible because of the accurate control of the intensity level of the ultraviolet (UV) lights, as well as providing controls which insure that the cooling for the lamps is not excessive when they are operating at low set intensities.

SUMMARY OF THE INVENTION

The present invention relates to improvements in ultraviolet (UV) lamp controls. The ultraviolet lamps are used for exposure of a film that is carried on an open mesh belt through a curing machine. The ultraviolet lamps are mounted in housing and reflector assemblies that extend across the width of the film web that is carried through the machine. The reflectors are arranged to have a radiation focal line extending across the web. The focal line is arranged to be at the level of the film, to concentrate the radiation from the UV lamp onto the film. The curing machines have the housing and reflector assemblies on opposite sides of one length of the belt which carries the film, so that both sides of the film are subjected to the ultraviolet radiation in the curing process.

The present invention specifically relates to controls for such ultraviolet lamps, which are accurate and reliable, so that the intensity of the light (radiation) from the ultraviolet lamps will be maintained at desired levels automatically as the lamps age or other conditions change.

At the same time, the cooling air across the lamps is controlled to insure that the lamps are not excessively cooled during times that the radiation level or light level is set to be relatively low. Excessive cooling causes the voltage to the lamp to drop, the current through the lamp to rise, and the light output to drop.

The controls make the device operate satisfactorily across a wide range of intensities, with little additional expense, but with substantial improvements in operation.

In particular, an ultraviolet sensor is mounted in a non-reflective sensor housing to sense the ultraviolet radiation intensity from each of the ultraviolet lamps. The current or power to the controlled ultraviolet lamp is varied through a closed loop control to maintain a precise level of ultraviolet radiation output. The sensor provides a means to sense and compensate for the aging of such ultraviolet lamps. The sensor housing has means for providing radiation from a substantially constant length of the arc from the lamp even as the lamp warps slightly and shifts transversely relative to the sensor, so accurate control is assured. An aging lamp has lower ultraviolet output level, and the closed loop control increases the power to the lamp to compensate for aging, to continue to hold a constant ultraviolet output until the lamp can no longer maintain the set point. Lamp failure can be indicated by an alarm used in the normal programming circuitry, so that it is known when the lamp must be replaced. The ultraviolet lamp control can be variable from about 30 percent to 100 percent output by having set points and suitable programable software in a normal microprocessor controller.

In this manner, belt speed can be fixed, and all radiation emitters can be precisely tuned for repetative cure cycles. The machine operates in connection with infrared heating elements as well.

BRIEF DESCRIPTION OF THE DRAWINGS

FIG. 1 is a schematic side sectional view of a typical film curing machine utilizing lamps and controls made according to the present invention;

FIG. 2 is a schematic end view of the curing machine shown in FIG. 1;

FIG. 3 is a part schematic cross sectional view of a typical arrangement of ultravioleet constant intensity lamps shown on opposite sides of the conveyor belt, and positioned according to the present invention;

FIG. 4 is a sectional view showing the construction of a housing for an ultraviolet light sensor;

DETAILED DESCRIPTION OF THE PREFERRED EMBODIMENTS

Figure 5:
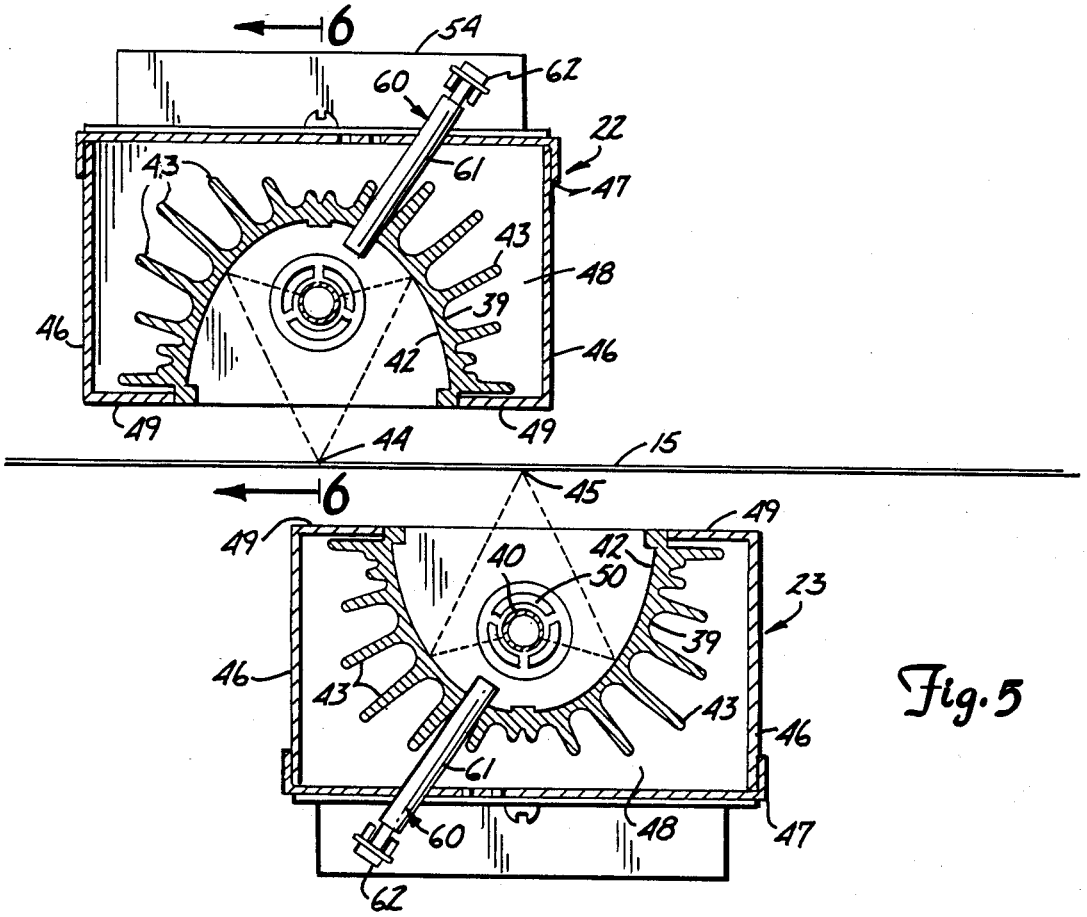
FIG. 5 is a sectional view taken on line 5—5 in FIG. 4.

A film curing machine indicated generally at 10 is shown only schematically because essentially the machine illustrated and discussed is conventional and includes a plurality of modules, formed on a frame 11. A conveyor entrance module 12 is at the input end of the machine, and permits the input of film, circuit boards and the like onto an open mesh or open wire conveyor chain indicated generally at 15, that is mounted over rollers or guides 13 and 14 at opposite ends. A motor indicated at 16 can be used for driving the belt at a desired speed, and the motor speed is controllable from a control module indicated generally at 20.

Also adjacent the input end of the machine, an ultraviolet (UV) radiation lamp section 21 that includes (UV) lamps controlled in accordance with the present invention is mounted, and as can be seen this includes reflector assembly 22 on the top side of the upper length of belt 12, and a reflector assembly 23 on the lower side. As can be seen, the reflector assemblies are slightly offset in longitudinal direction of the conveyor 15. The upper length of conveyor 15 is made to move in direction indicated by the arrow 25.

Two modules 26 of infrared heaters, which have heater sections above and below the belt in the same manner as the ultraviolet sections, are provided for the necessary heating. The infrared heater can be controlled from the control module 20. A second ultraviolet section 27, made in substantially the same manner as section 21, is used in series, and can be used for providing the necessary curing or heating of the film and components on the conveyor belt.

An exhaust module 30 is utilized in series, in a conventional manner and provides for exhausting of fumes and other vapors from the entire machine assembly. A cooling module indicated at 31 is also provided in a known manner, and then there is an exit or output module 32 that provides access to the upper length of the belt so that the products indicated at 33 in FIG. 1 can be removed. The product comprises films, circuit boards or other items that are being processed.

The modules have a common housing shown in dotted lines in 35 in FIG. 2 that can be hinged up for access to the conveyor belt 15, and also the upper and lower reflector assemblies 22 and 23 of each of the ultraviolet modules 21 and 27 are separated when the housing 35 is in its raised position.

Referring to FIG. 3, an enlarged cross sectional view of two of the ultraviolet lamp and housing assemblies 22 and 23 with their reflectors is shown in relation to the mesh belt 15. The film that is being processed is on the upper surface of the mesh belt 15. The first reflector assembly 22 is at the top, as shown previously, and the second reflector assembly 23 is shown at the bottom. Also as can be seen in FIG. 3, the interior surface of the reflectors are generally eliptical and provide a reflected light path from a lamp back into the film in the film curing machine.

Figure 6:
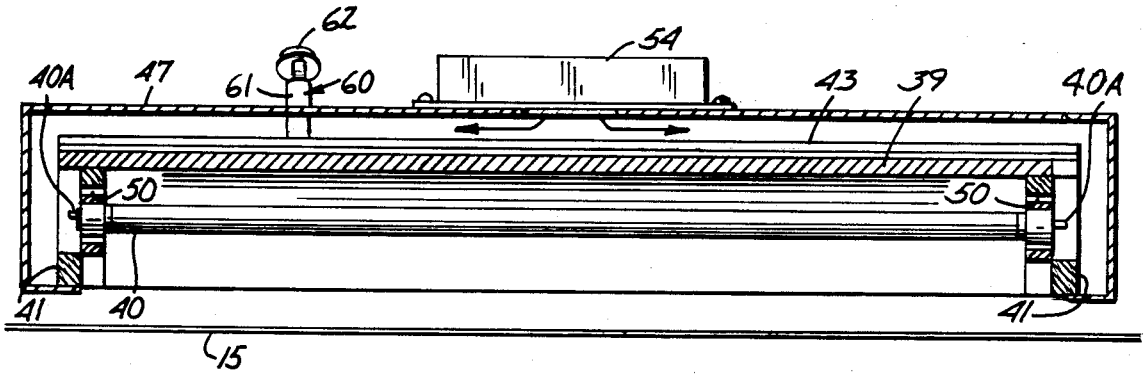
FIG. 6 is a fragmentary sectional view taken on line 6—6 in FIG. 2 showing an airflow path for cooling air across the ultraviolet lamps.

As can be seen in FIG. 3, the ultraviolet lamps indicated at 40 are positioned in suitable end supports 41 on the reflectors 39 (see also FIG. 6). There is one of the end supports 41 at each end of the lamps 40. The reflectors 34 have polished inner surface 42, and as can be seen in FIG. 3 have radiating fins 43 on the outer side.

The inner surface 42 of each reflector is elongated along a central axis on which the lamps 40 are mounted. The reflector surface 42 has a cross sectional shape as shown in FIG. 3 that is generally eliptical, and forms a central focal line, which is shown as a point in cross section. Focal line 44 is shown for the reflector assembly 22, and focal line 45 is shown for the reflector assembly 23. The conveyor belt 15 as shown is in between the two reflector assemblies 22 and 23 and the focal lines 44 and 45 concentrating the ultraviolet radiation from the lamps 40 are thus offset longitudinally a slight distance.

The showing in FIGS. 3 and 6 is part schematic, and shows that the reflector assemblies 22 and 23 each have an outer housing or cover 47, including side wall panels 46 that join lower edge flanges 49 to form an enclosed space indicated at 48 around the reflector assemblies, and thus above the radiating fins 43. A flange extends in from each end of the housing assemblies to support the end supports 41. The chamber 48 is enclosed except for desired inlet and out openings. As shown, end seal assemblies 50 surround the end portions or connectors 40A of the lamps 40. The end seal assemblies are made of a ceramic material and it is necessary to have airflow across these end seal assemblies in order to maintain them at the proper temperature for sealing relationship.

A fan indicated at 54 is mounted on the upper surface of the housing 40, of each of the reflector assemblies, and when powered the fans will draw air from the top, through an opening in the respective housing 46 and as shown by the arrows 55 across the fins 43 to provide cooling of the reflectors, and the air then flows out past the end seals 50. The cooling of the reflector cools the lamps 40 as well.

The ultraviolet lamps 40 operate with an arc being formed between the end connectors 40A when the lamp is started. The starting voltage is controlled by conventional starting modules to be high enough to make an arc between the ends of the lamps 40. The controllers sense the voltage across the lamps and will go into the start mode when the voltage drops below about 300 volts.

The intensity of the light is adjustable by adjusting the operating power, primarily by adjusting the current. However, certain perameters must be met. The normal operating voltage, from a provided power supply is in the range of 840 volts, and as stated, if the voltage drops down below 300 volts the power supply will go into "starting mode" automatically. This will provide a high surge of current to restart the lamps. Thus, low voltages are to be avoided. Controlling the current to the lamps adjusts the intensity of light or UV radiation, and thus changes in intensity can be made by adjustment of the conventional power supply. It is also known that as the lamp ages the intensity reduces at the same power setting. Compensation has previously been done by manually adjusting the power output.

If it is desired to adjust the ultraviolet light level to a low level, for example to balance the ouputs in relations to the infrared heating modules in the dry film curing machine, care must be made so that the UV lamp is not excessively cooled by the fan that is used or the lamp voltage will drop below the start voltage level and current surges will occur. However, also, it is desired that the lamp intensity be maintained at the set level even as the lamp ages. Thus, to accomplish these objectives, the present control circuits have been developed to provide closed loop control. Each of the housings 47 and reflectors has a radiation or light sensitive sensor assembly indicated generally at 60 mounted thereon.

The sensor assembly 60 includes a tubular housing 61 (See FIG. 4), and at the outer end of the housing 61, that is the end of the housing outside of the cover 47, a light sensitive diode sensor 62, comprising a type T05 diode is mounted.

This diode sensor 62 is a known light sensitive solid state element that provides an output signal proportional to light intensity striking it. The quartz envelope on the outside of the lamp 40 which surrounds and contains the electrodes and interior gases and in which the arc is formed will tend to warp as it heats up. This will shift the arc slightly from a straight line or axis between the lamp end supports. Thus if a light sensor is placed in one position, the portion of the arc that is being viewed by the sensor can change and this will in effect change the output of the light sensor or radiation sensor even if the intensity has not changed. Additionally, reflected light on the interior of any housing can cause readings other than true light intensity.

Thus, the sensor assembly 60 is made to avoid these problems. The problem of the shifting arc and changing light sample sensed or sampled by the sensor 62 as the arc tends to bend, is solved by using a slotted wall or disc 63 at the inner end of the circular cross section tubular housing 61, that is adjacent to the light. Disc 63 has a slot indicated at 64 in FIG. 5 which is substantially smaller than the diameter of the outer housing tube 61, and this slot is elongated in direction that is perpendicular to the arc length. The arc is indicated at 65 in FIG. 5, and the dotted line positions of the arc show that the same amount (length) of arc will be received or sensed by the sensor 62 even though the arc shifts slightly from lamp warpage. The sensor housing is placed adjacent one end of the lamp. The portion of the arc being sensed is not right at one of the electrodes where variation of intensity from aging may not be apparent, but is at a location where bowing causes less shifting than in the center of the quarz envelope surrounding the arc of the lamp 40.

Reflected light problems are corrected by using a coiled spring 66 on the interior of the housing is embedded in a non-reflective (flat black) coating and tightly engages the inner surface of the housing and blocks reflected light along the interior surface of the tube 61. The only radiation being received by the sensor 62 is that entitled by the short sample arc itself, without reflected radiation. Further, the length of the sample of the arc viewed by the sensor remains the same because of the slot 64 in relation to the housing size and arc size.

It should be noted that if a full circle end opening of the tube 61 was used, as the arc would shift toward the top or bottom of the tube, the amount of arc that would be viewed would change because of the curvature of the tube. In other words, length of the arc viewed would be equal to the diameter at the center, which is greater than the chord length of a circle when the arc shifted. The diode sensor 62 includes a short mounting tube 62A that is coaxial with tube 61. The diode sensor can be mounted in any desired manner, the short tube 62A also has a helical spring 62 therein. The tube 62A is very short and is not always needed. The main tube 61 provides a larger diameter to insure adequate light intensity of the arc sample visible to the diode 62 when the tube 61 is of length to permit mounting the diode sensor on the outside of housing 47 with the inner end adajacent the lamp 40.

Figure 7:
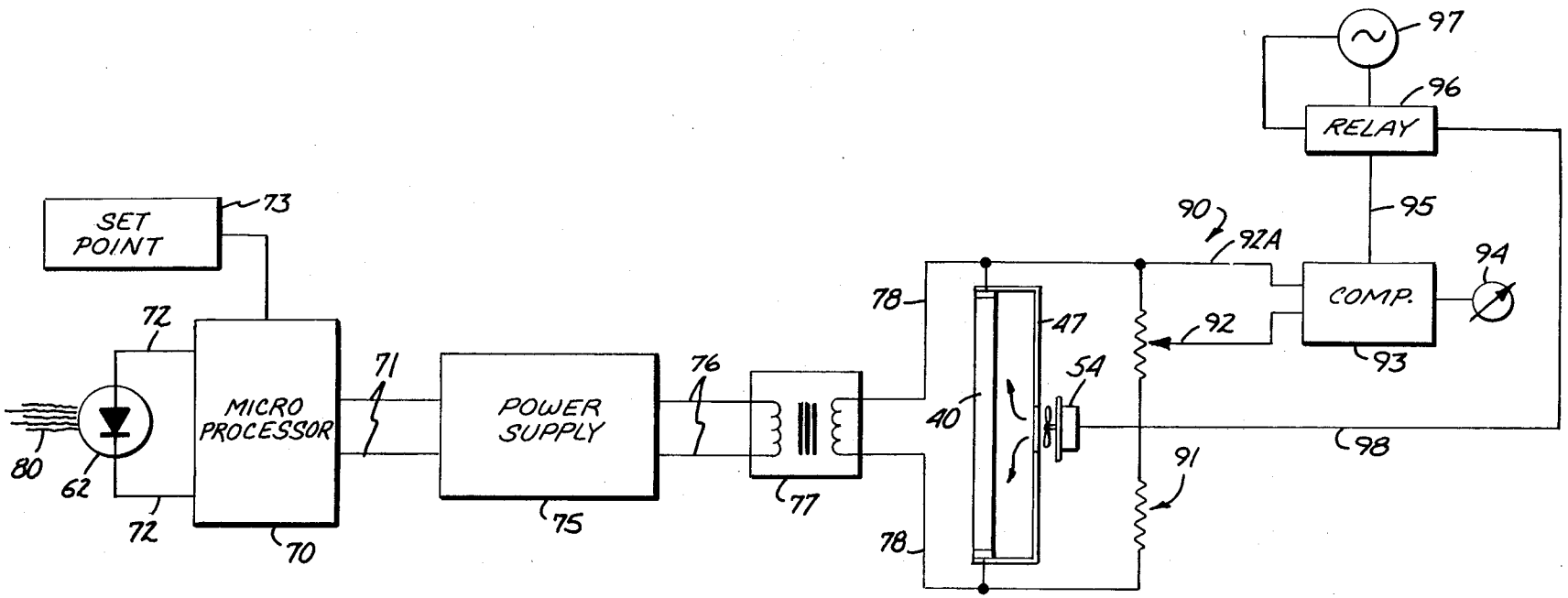
FIG. 7 is a schematic representation of the control circuits used for controlling light intensity and fan cooling utilized with the present invention.

Thus, with an accurate sensor, a circuit such as that shown in FIG. 7 can provide close loop control. The sensor 62 provides a signal to a microprocessor indicated at 70 of conventional design that is programmed to provide an output control signals along line 71 that is proportional to that provided at the input lines 72 from the sensor 62. The sensor 62 comprises a light sensitive diode.

A set point control 72 is provided at the input of the microprocessor 70 to permit adjustment of the set point desired in a conventional manner. The processor 70 provides a control signal on lines 71 which is the error signal, that is the difference between the set point and the feedback signal from sensor 62. The set point is used so that the intensity level can be reduced or increased to maximum as desired. Once set, the output signal will be adjusted to a power supply 75 to change the output of the power supply 75 and the power to the UV lamp until the sensor signal is restored to its desired level. Line 71 provides signal to the power supply, and the light intensity level can be reduced or increased with the adjustable set point control to maximum as desired, but once set it will not shift because shifts in the sensor input signal will cause shifts in the control signal to the power supply. The power supply 75 comprises an SCR controller 75 of conventional design that delivers power along lines 76 through a current limiting transformer 77 also of conventional design, at a desired voltage. The transformer 77 provides output power along lines 78 to the lamp indicated at 40 schematically in FIG. 7.

Changes in the intensity of the light or radiation from the lamp (40 which light is indicated by the lines 80 in the FIG. 7) causes the microprocessor to provide a changed input signal on line 71 and adjust the power supply output until the intensity of the lamp 40 is restored to its desired level.

FIG. 7 also shows schematically the circuit for maintaining a desired cooling effect for each reflector assembly and its lamp 40. As was stated, unless the lamp 40 is properly cooled, the lamp gets hot enough so that it destroys itself. The UV lamp-reflector assemblies are manufactured with cooling fins 43, but when the intensity level of the lamps is to be controlled at a reduced level, less than its maximum output, the amount of cooling air that is provided by continuously running the fans 54 cools the lamps to a point where the lamp voltage drops below the start voltage, causing the standard SCR power supply to shift into a start phase that provides a surge of current. The surge of current in the start cycle level from the power supply is conventional at the present time, and as was stated, as the operating lamp cools the voltage drops. When controlling the intensity to a low level if the lamp is excessively cooled the voltage may drop too low.

To overcome this difficulty, the fan 54 is controlled to be on and off intermittently depending upon the voltage level across the lamp itself.

This circuit is indicated generally at 90 in FIG. 7, and an attenuating resistor indicated generally at 91 is placed across the lamp. The lamp voltage is normally in the range of 800 or so volts, and should be controlled to be within a desired range. A voltage tap using a typical slider arm 92 is used to sense a voltage of approximately six volts AC on arm 90 for providing a signal that is proportional to the voltage across the lamp. This signal then is fed to a comparator 93.

The six volt signal is sufficient to provide an input to the comparator with respect to a voltage that is adjusted by a set point control 94. When the voltage to the comparator is such that when the voltage on slider arm 92 with respect to circuit common on line 92A is at a desired level, a signal is provided along the line 95 to a solid state relay 96 to switch on power from a source 97 through a line 98 to the fan 54 which will then start cooling the reflector by forcing air through the chamber 48 as previously explained.

If the level of the light intensity is set so that the lamps 40 are not delivering their full output and the voltage starts to drop, when it drops below a desired level the comparator senses that the input voltage is below the set point voltage and the comparator will turn off relay or switch 96, and the fan 54 will be turned off, so that the lamp 40 does not cool sufficiently to go automatically into its starting mode.

The voltage differential between the turn on and turn off voltages can be in the range 15 volts as actually measured across the lamp and then of course it would be proportionally lower voltage on the line 92 because of the attenuator resistor 91.

By combining these features, the intensity of the ultraviolet lamps 40 can be controlled at a desired level, and then maintained at this level through the use of the disclosed sensor without having the lamps go into starting mode accidentially because of excessive cooling at low set intensities. The circuits are straight forward and easily used to provide a closed loop control for the intensity and cooling functions. Accurate sensing of the light from the arc even after warping of the lamp outer envelope by the use of the slot on the end of the sensor housing provides a key to avoid difficulties with inaccurate sensing. The sensor compensates for decay in the lamp output as well as for power shifts that might occur in the power supply due to component aging and the like.

Accurate sensing is further enhanced by having the focal lines offset as one light does not adversely affect the sensor or the associated reflector. Also, the tubes 61 are included in direction so they are not likely to receive stray light from the other associated reflectors (See FIG. 3).

The intensity can be varied from a low of 30 percent of maximum intensity, so long as the fan 54 is properly monitored to prevent the operating voltage from dropping too low. With the constant ultraviolet light level, the film drying machine can be fine tuned so that the belt speed can be maintained at a desired set speed, and the other operating parameters can be left at their operating conditions. Then the normal variable of the intensity of the ultraviolet radiation used from the reflectors 22 and 23 will no longer be a problem in continuous operation.

What is claimed is:

1. For use in an ultraviolet light system having an ultraviolet lamp providing ultraviolet radiation from an elongated arc between ends, and having an adjustable voltage power supply, an improved closed loop control sensor comprising:

a light intensity sensor providing an output signal proportional to light intensity;

a housing for said sensor mounting said sensor adjacent said lamp and having means for providing radiation of a substantially constant length of the arc from the lamp onto the sensor across a desired range of lateral movement of the arc of the lamp transverse to the arc length.

2. The sensor of claim 1 wherein the means for providing comprises a wall having a slot with a width dimension generally parallel to the arc length, the slot being elongated in direction perpendicular to its width, and centered on the central axis of a lamp to be sensed.

3. The sensor of claim 2 wherein said housing comprises an elongated tube, said wall having a slot being mounted at an end of said tube adjacent the ultraviolet lamp to be sensed, and the sensor being mounted in an opposite end of the tube from the wall.

4. The sensor of claim 1 wherein the means for providing comprises a housing having a radiation inlet opening that is generally elongated in a direction transverse to the arc and which maintains a constant width in direction parallel to the arc across the range of deflection of the arc.

5. The sensor of claim 2 and a helical member positioned on the interior wall of said tube to substantially eliminate reflected light from affecting the sensor.

6. The sensor of claim 1 in combination with a light reflector assembly including an ultraviolet lamp, an elongated polished reflector mounting said lamp and extending in direction along the length of the lamp, said sensor being mounted on said reflector to receive light directly from said lamp.

7. The combination of claim 6 and means to mount the reflector in a drying machine having a open mesh belt and having two reflectors, one on the top and one on the bottom of a belt length, both the reflectors being of the type providing a line of concentrated light from the respective ultraviolet lamps at a focal line extending in a direction along the reflectors, the focal lines of the reflectors being substantially parallel and off set slightly in direction in movement of the belt length.

8. The combination of claim 6 and means to form a housing over the reflector when in use to provide a cooling chamber, and fan means to provide an air flow through said chamber to cool the reflector.

9. The combination of claim 8 and means to sense the voltage across the lamp, and to provide a signal to turn the fan off when the voltage across the lamp drops below a selected level.

10. The combination of claim 7 wherein there are two sets of reflectors spaced farther down the belt from the first set of reflectors, and the second set of reflectors being substantially identical to the first set of reflectors.

11. A sensor assembly for sensing light levels from an arc type light having an elongated arc extending in a first direction, said sensor comprising:

a tubular housing;

a light sensor at a first end of said housing;

a blocking wall member at a second end of said housing, said blocking wall member having a preselected size slot extending across the tubular housing in a second direction perpendicular to the first direction, and having a width perpendicular to the second direction substantially less than the length of the slot; and means to position housing at a desired location adjacent an arc formed in a lamp to be sensed.

12. The apparatus as specified in claim 11, and a helical spring extending spirally along the interior surface of said tubular housing, said tubular housing having a generally circular cross section, and said spring preventing reflected light from being transmitted to the sensor at the first end of said tubular housing.

13. The apparatus of claim 11, and a power supply for powering a lamp, control means between said sensor and said power supply to control said power supply as a function of the signal from said lamp to maintain the intensity level of the lamp at a desired condition.

14. In combination with a dry film curing machine, said curing machine having an open mesh belt movable in a first direction, and having a plurality of modules for treating a film to be dried and moving it along said belt, at least one of said modules comprising an ultraviolet heater assembly including first and second reflectors on opposite side of said belt, said reflectors each having:

a polished reflector side facing said belt;

an ultraviolet light emitting lamp mounted in said reflector and extending transversely to said belt, said ultraviolet lamp having an elongated arc formed therein when in use;

a light sensor mounted at a location spaced from an end of the lamp a desired amount, said sensor comprising a tubular member having an axis directed toward said arc, a light sensitive diode at an end of said tubular member opposite from said lamp, and a helical spring mounted on the interior side of said tubular member to prevent reflected light from striking said diode.

15. The apparatus as specified in claim 14, wherein said tubular member has a wall at an end adjacent said lamp, said wall having a slot substantially narrower than the diameter of said tubular member and extending lengthwise in a direction perpendicular to the arc to permit the arc in the lamp to shift without changing the portion of the arc emitting radiation to the interior of said tubular member.

16. The apparatus as specified in claim 15, and a power supply powering each of said lamps, said power supplies having adjustable power outputs in response to input signals, and control means coupled to the diode and providing a control signal to said power supply as a function of a radiation received by said diode to thereby provide a control for the output of the power supply and the intensity of the light from the lamps as a function of the signal from said diode.

17. The apparatus as specified in claim 16 and a fan mounted on said reflectors for cooling said lamps, means to sense the voltage across said lamps and for providing a signal to shut said fan off when the voltage drops below a desired level.

18. The apparatus as specified in claim 17 and means to position said reflector on a first side of the belt at a longitudinally offset location from the second reflector.

* * * * *